US009799979B2

(12) United States Patent
Kamo et al.

(10) Patent No.: US 9,799,979 B2
(45) Date of Patent: Oct. 24, 2017

(54) SOCKET FOR CONNECTING LEADS USING AN OPERATION DRIVER

(71) Applicant: OMRON Corporation, Kyoto-shi, Kyoto (JP)

(72) Inventors: Ryunosuke Kamo, Usuki (JP); Kenichiro Masaki, Kikuchi-gun (JP); Tomokazu Ikeda, Yamaga (JP); Keisuke Yano, Kikuchi (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 15/248,492

(22) Filed: Aug. 26, 2016

(65) Prior Publication Data

US 2017/0093073 A1 Mar. 30, 2017

(30) Foreign Application Priority Data

Sep. 15, 2015 (JP) ..... 2015-182123

(51) Int. Cl.

| | |
|---|---|
| ***H01R 4/48*** | (2006.01) |
| ***H01R 13/40*** | (2006.01) |
| *H01R 9/24* | (2006.01) |
| *H01R 13/506* | (2006.01) |
| *H01R 4/52* | (2006.01) |
| *H01R 13/56* | (2006.01) |
| *H01R 13/58* | (2006.01) |

(52) U.S. Cl.

CPC ..... *H01R 13/40* (2013.01); *H01R 4/48* (2013.01); *H01R 4/4827* (2013.01); *H01R 4/4845* (2013.01); *H01R 4/4818* (2013.01); *H01R 4/52* (2013.01); *H01R 9/24* (2013.01); *H01R 13/506* (2013.01); *H01R 13/562* (2013.01); *H01R 13/58* (2013.01)

(58) Field of Classification Search

CPC ..... H01R 4/48; H01R 4/4818; H01R 13/562; H01R 13/58; H01R 4/52; H01R 4/4845; H01R 4/4827

USPC ..... 439/786, 787, 834, 835, 474, 436, 441, 439/438

See application file for complete search history.

(56) References Cited

U.S. PATENT DOCUMENTS

| | | | | |
|---|---|---|---|---|
| 7,704,095 | B2 * | 4/2010 | Stromiedel | H01R 4/4818 439/436 |
| 8,251,738 | B2 * | 8/2012 | Heckert | H01R 4/4836 439/441 |
| 2005/0042912 | A1 | 2/2005 | Drewes et al. | |

(Continued)

FOREIGN PATENT DOCUMENTS

| | | | | |
|---|---|---|---|---|
| DE | 20210105 | U1 | 10/2002 | |
| DE | 102009004513 | A1 | 7/2010 | |
| EP | 1429418 | A1 * | 6/2004 | H01R 4/4836 |

*Primary Examiner* — Abdullah Riyami
*Assistant Examiner* — Justin Kratt
(74) *Attorney, Agent, or Firm* — Metrolexis Law Group, PLLC

(57) ABSTRACT

A socket includes a base and a connection fitting including a bracket and a spring member and assembled to an upper surface of the base. The spring member of the connection fitting is pressed and elastically deformed to sandwich a lead between the bracket and the spring member. A position restricting protrusion configured to come into contact with the pressed and deformed spring member and prevent plastic deformation is protruded on the upper surface of the base.

13 Claims, 9 Drawing Sheets

(56) References Cited

U.S. PATENT DOCUMENTS

2011/0312228 A1 12/2011 Schrader
2014/0065892 A1* 3/2014 Jun ..... H01R 4/4827
439/787

* cited by examiner

SOCKET FOR CONNECTING LEADS USING AN OPERATION DRIVER

CROSS-REFERENCE TO RELATED APPLICATION

This application is based on Japanese Patent Application No. 2015-182123 filed with the Japan Patent Office on Sep. 15, 2015, the entire contents of which are incorporated herein by reference.

FIELD

The present invention relates to a socket and, more particularly, relates to a socket which connects leads by using an operation driver.

BACKGROUND

Conventionally, a socket which connects leads by using an operation driver is formed by, for example, assembling in a housing a connection fitting including a bracket and a spring member. Further, there is a socket which causes the operation driver inserted in the housing to elastically deform the spring member to sandwich the leads between the bracket and the spring member (see German Patent No. 102009004513).

However, the socket has a problem that, when an operation driver 56 is inserted in a housing 52 to elastically deform a spring member 10 as shown in FIG. 10, the operation driver 56 is erroneously operated and the spring member 10 is plastically deformed.

SUMMARY

In view of the problem, an object of a socket according to the present invention is to provide a socket which prevents plastic deformation of a spring member of a connection fitting.

To solve the above problem, a socket according to the present invention is a socket including a base and a connection fitting including a bracket and a spring member and assembled to an upper surface of the base, the spring member of the connection fitting being pressed and elastically deformed to sandwich a lead between the bracket and the spring member, in which a position restricting protrusion configured to come into contact with the pressed and deformed spring member and prevent plastic deformation is protruded on the upper surface of the base.

The present invention can provide a socket which can prevent plastic deformation of the spring member since, when the operation driver presses and deforms the spring member, the spring member comes into contact with the position restricting protrusion and a position of the spring member is restricted.

According to the embodiment of the present invention, the position restricting protrusion may be integrally molded with the base.

According to the embodiment, it is possible to provide a socket having small numbers of parts and assembly man-hours and high productivity.

According to another embodiment of the present invention, a position restricting tapered surface which the spring member comes into planar contact with may be formed at an upper end of the position restricting protrusion.

According to the embodiment, the spring member comes into planar contact with the position restricting tapered surface of the position restricting protrusion, and the position of the spring member is restricted. Consequently, it is possible to provide a socket which hardly causes stress concentration and whose spring member is more hardly plastically deformed.

According to another embodiment of the present invention, a fitting hole configured to fit to the position restricting protrusion protruded from the base may be provided to the bracket of the connection fitting.

According to the embodiment, the bracket can be accurately assembled to the base via the position restricting protrusion of the base, so that it is possible to obtain a socket of high assembly precision.

According to a different embodiment of the present invention, a guide partition wall may be bridged between and integrally molded with a ceiling surface and an inside surface of a case cover of a box shape configured to fit to the base and cover the connection fitting, the guide partition wall may engage with a slit provided to the bracket and the spring member of the connection fitting, and an operation driver inserted along the guide partition wall through an operation hole provided on the ceiling surface of the case cover may press and elastically deform a pressure spring of the spring member.

According to the embodiment, the guide partition wall bridged between and integrally molded with the ceiling surface and the inside surface of the case cover engages with the slit provided to the bracket and the spring member of the connection fitting. Hence, the guide partition wall partitions neighboring pressure springs of the spring member. As a result, it is possible to prevent erroneous insertion of leads, improve assembly precision and prevent connection failure.

Further, the guide partition wall is bridged between and integrally molded with the ceiling surface and the inside surface of the case cover. Hence, even when the operation driver is erroneously inserted, the guide partition wall is not broken, and broken pieces are not produced. As a result, it is possible to provide a socket which does not cause connection failure caused by the broken pieces.

According to a new embodiment of the present invention, a notch configured to engage with the position restricting protrusion provided to the base may be formed at a lower end rim of the guide partition wall.

According to the embodiment, there is an advantage that support strength of the guide partition wall further increases, and not only connection failure does not occur but also rigidity of the entire case cover increases, so that it is possible to provide a socket adopting a firm structure.

DETAILED DESCRIPTION

Embodiments of a socket according to the present invention will be described with reference to accompanying drawings of FIGS. 1 to 14.

The socket according to a first embodiment is formed by a base 10, a connection fitting 20 and a case cover 40 as shown in the accompanying drawings of FIGS. 1 to 10.

Figure 6:
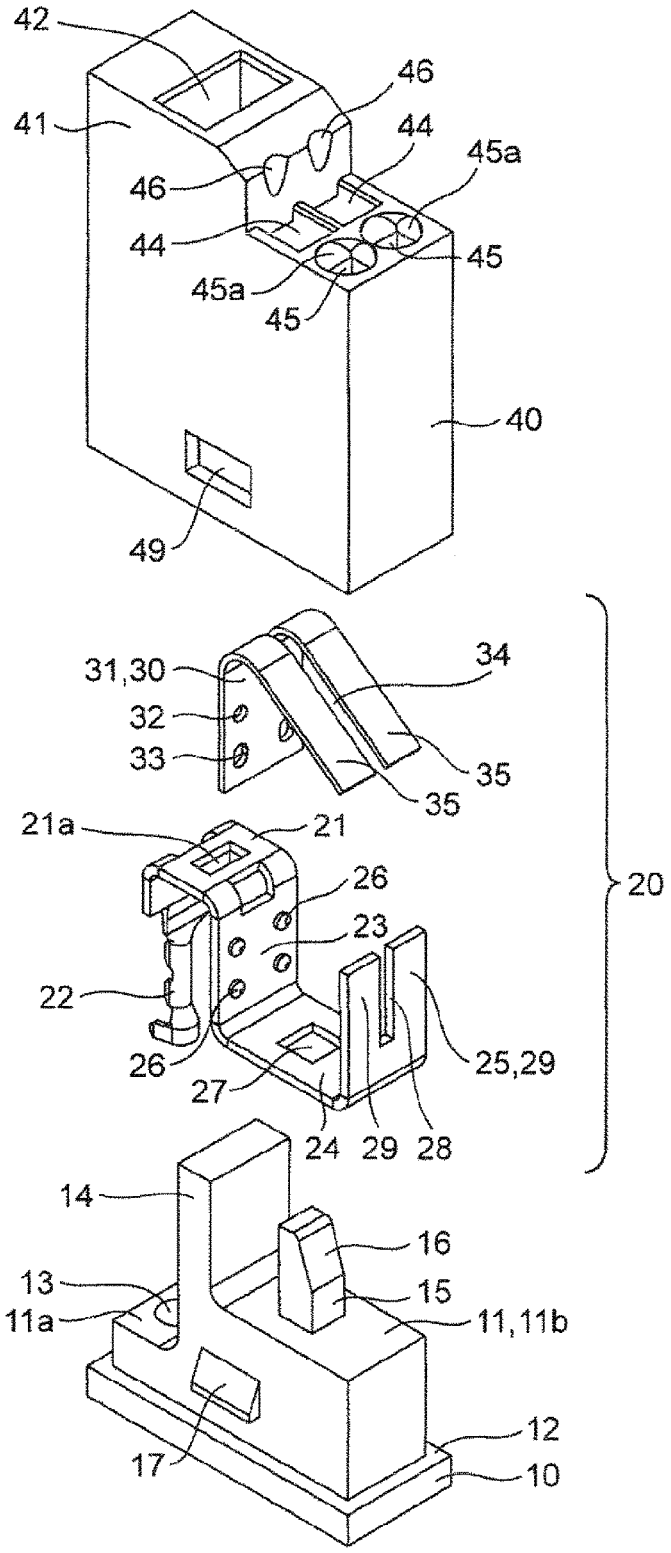
FIG. 6 is an exploded perspective view of the socket shown in FIG. 1.
Figure 7:
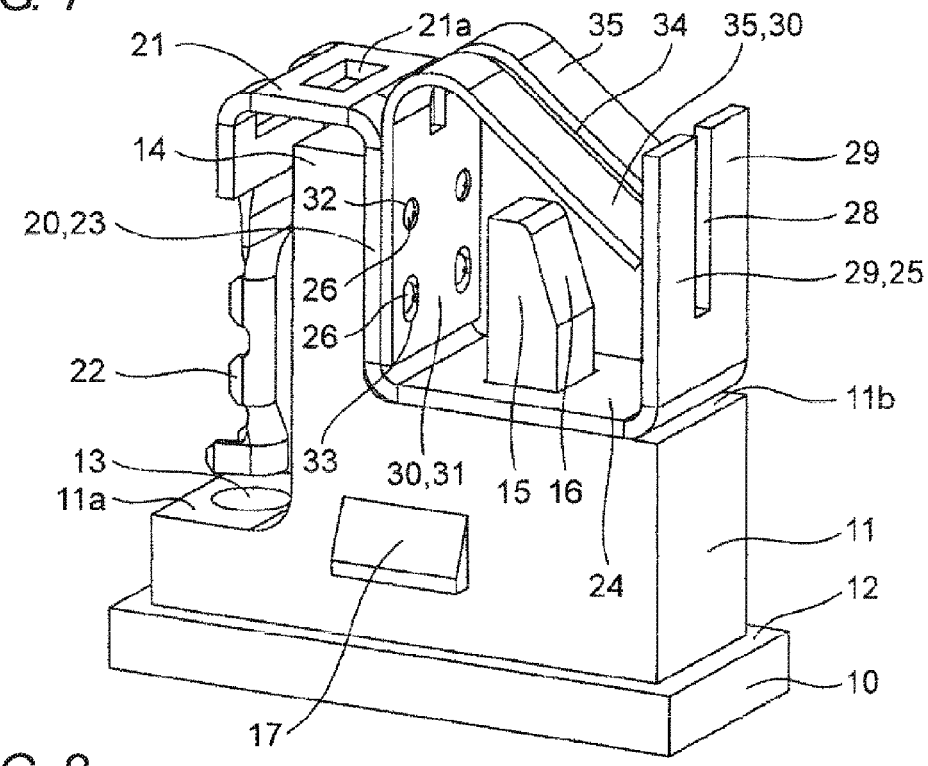
FIG. 7 is a perspective view illustrating a state where a case cover is detached from the socket shown in FIG. 1.
Figure 8:
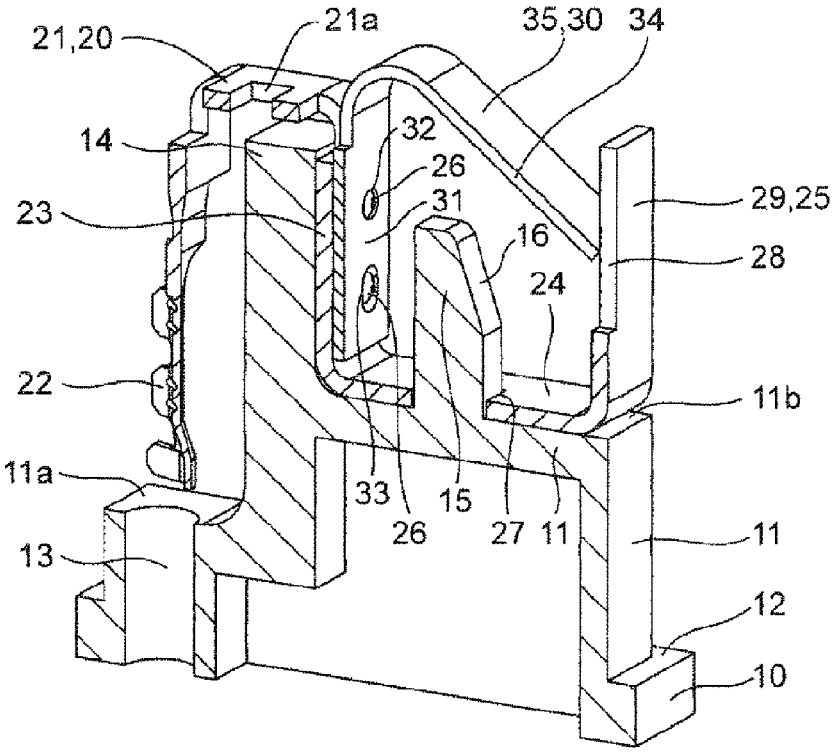
FIG. 8 is a vertical sectional view of the socket shown in FIG. 7.
Figure 9:
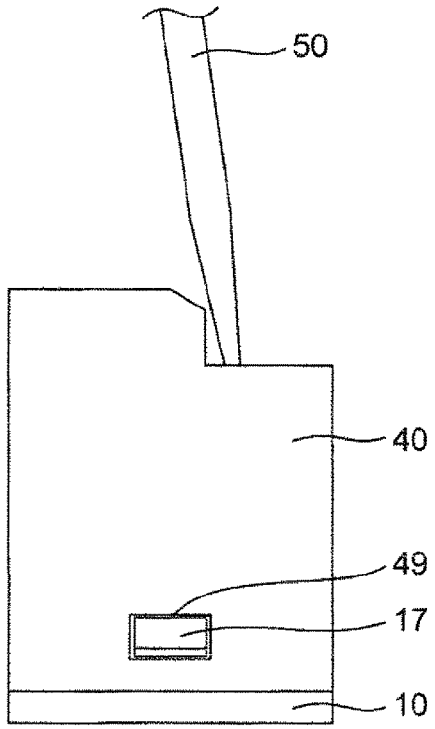
FIG. 9 is a left side view for explaining a method for using the socket shown in FIG. 1.

As shown in FIG. 6, a seating 11 is protruded from an upper surface of the base 10 to form an annular step 12. A connection hole 13 is provided in an upper surface 11*a* which is one step lower in the upper surface of the seating 11. Further, a support protrusion 14 is protruded at a rim of an upper surface 11*b* which is one step higher in the upper surface of the seating 11. Furthermore, a position restricting protrusion 15 is integrally molded with a nearly center of the upper surface 11*b*.

The position restricting protrusion 15 includes a position restricting tapered surface 16 at an upper end of the position restricting protrusion 15. Further, engagement claws 17 and 17 are protruded along a longitudinal direction of the seating 11 and on opposing outside surfaces.

In addition, in the embodiment, the position restricting protrusion 15 is integrally molded with the base 10, and the connection fitting 20 described below is assembled to the base 10. Hence, precision to position the connection fitting 20 is high, and an assembly error is little. As a result, when an operation driver (not shown) presses pressure springs 35 of the connection fitting 20, a pressing position does not vary, so that it is possible to effectively prevent occurrence of plastic deformation.

Particularly, the position restricting tapered surface 16 has an inclined angle which can come into planar contact with the pressure springs 35 when the pressure springs 35 of the connection fitting 20 described below elastically deform. Consequently, it is possible to effectively prevent plastic deformation of the pressure springs 35.

As shown in FIG. 6, the connection fitting 20 is formed by a bracket 21 and a spring member 30 whose sectional shape is a nearly V shape.

A retaining portion 22 is formed at one side of the bracket 21 provided with a through-hole 21*a* by bending a conductive metal plate by way of press working, and a caulked portion 23, a bottom portion 24 and a pressure contact portion 25 are formed at the other side.

The retaining portion 22 has a shape which can retain leads which are not shown by way of caulking work.

Further, the caulked portion 23 is formed by having a plurality of caulking projections 26 project from a surface of the caulked portion 23, and a square fitting hole 27 is formed in the bottom portion 24. Furthermore, a pair of pressure contact receiving portions 29 and 29 are formed by dividing the pressure contact portion 25 into two in the width direction by a slit 28 formed at a free end of the pressure contact portion 25.

The spring member 30 is bent in a nearly V shape, and has pluralities of caulking small holes 32 and caulking large holes 33 at the caulked portion 31 at one side of the spring member 30. Further, the spring member 30 has a slit 34 at a free end which elastically deforms at the other side of the spring member 30 to form a pair of pressure springs 35 and 35.

Furthermore, by caulking and fixing the caulking small holes 32 and the caulking large holes 33 of the spring member 30 to the caulking projections 26 and 26 of the bracket 21, leading end portions of the pressure springs 35 and 35 of the spring member 30 come into pressure contact with the pressure contact receiving portions 29 and 29 of the bracket 21.

Hence, the fitting hole 27 provided to the bottom portion 24 of the bracket 21 is fitted to and assembled to the position restricting protrusion 15 of the base 10. Further, leads which are not shown and are inserted from a lower side via the connection hole 13 of the base 10 are caulked and fixed to and are electrically connected to the retaining portion 22 of the bracket 21.

Figure 4:
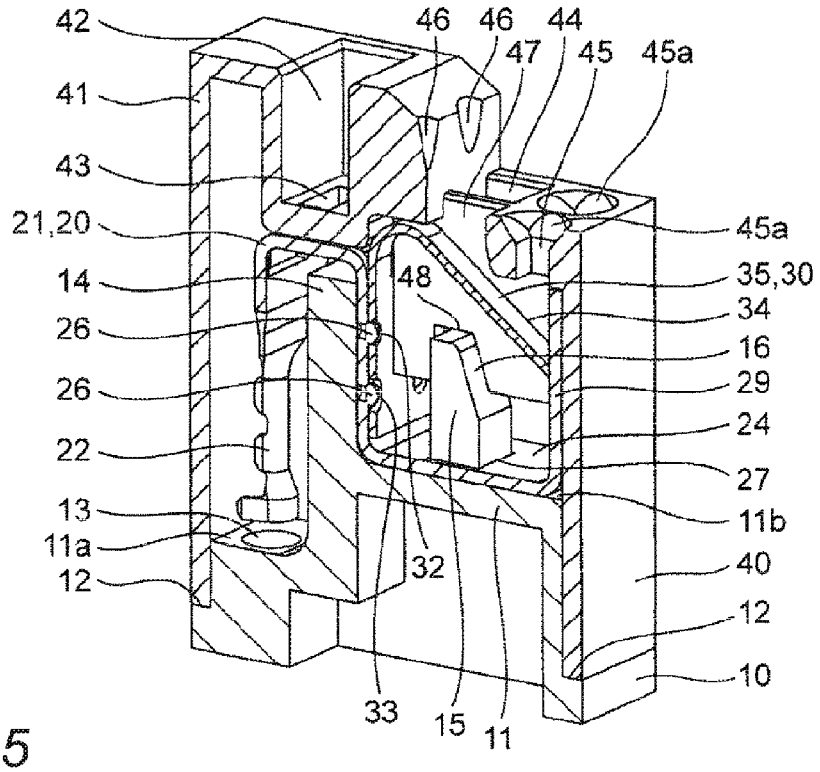
FIG. 4 is a vertical sectional view of the socket shown in FIG. 1.

As shown in FIG. 4, the case cover 40 has a box shape which can fit to the annular step 12 of the base 10, and has a step shape including a step 41 at a single side of an upper surface of the box shape. Further, at a position corresponding to an upper end surface of the support protrusion 14 of the base 10 on an upper surface of the step 41, a recessed portion 42 is formed. Furthermore, at a bottom surface of the recessed portion 42, a through-hole 43 (FIG. 5) continuing to the through-hole 21 *a* of the bracket 21 is formed. Hence, the bracket 21 can be electrically connected to the bracket 21 of another neighboring socket (not shown) via the through-hole 43 of the case cover 40.

Further, at a position corresponding to an intermediate area of the pressure springs 35 on the upper surface except the step 41, the case cover 40 has an operation hole 44 in which the operation driver not shown can be inserted. Furthermore, at a position corresponding to free ends of the pressure springs 35, insertion holes 45 in which leads can be inserted are formed. At an opening rim of each insertion hole 45, a chamfered portion 45*a* which makes it easy to insert leads is formed.

Further, at a corner of the step 41, a guide notch 46 having substantially a semi-arc surface is formed to guide the operation driver which is inserted in the operation hole 44.

Figure 5:
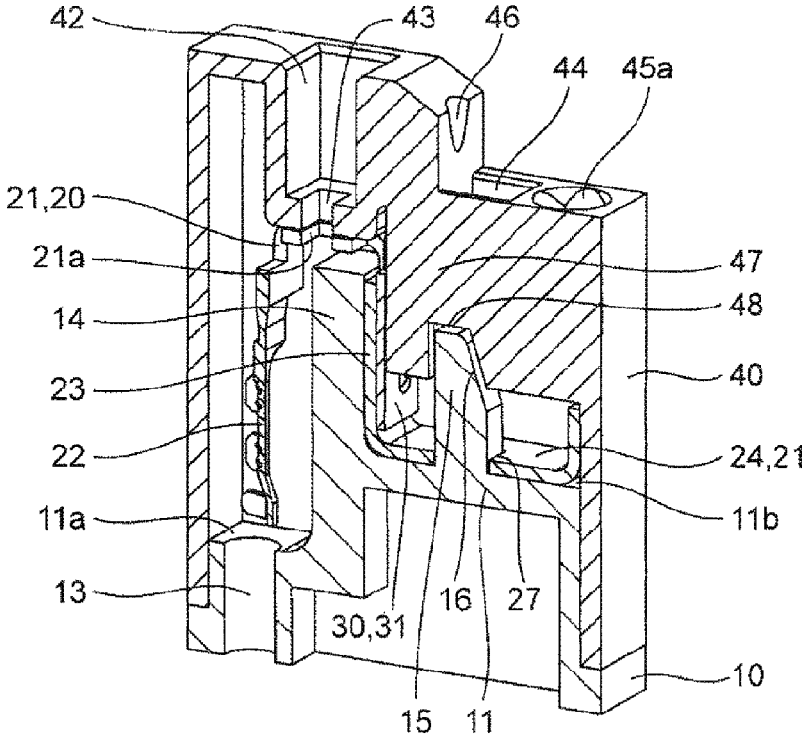
FIG. 5 is a vertical sectional view cut at a different position of the socket shown in FIG. 1.

Furthermore, as shown in FIGS. 4 and 5, the case cover 40 is integrally molded with a guide partition wall 47 to bridge the guide partition wall 47 between a ceiling surface and an inside surface of the case cover 40. The guide partition wall 47 may engage with the slit 28 provided to the bracket 21 and the slit 34 of the spring member 30. Further, the guide partition wall 47 includes at a lower end rim of the guide partition wall 47 a notch 48 (FIG. 5) which engages with the position restricting protrusion 15 of the base 10.

Figure 1:
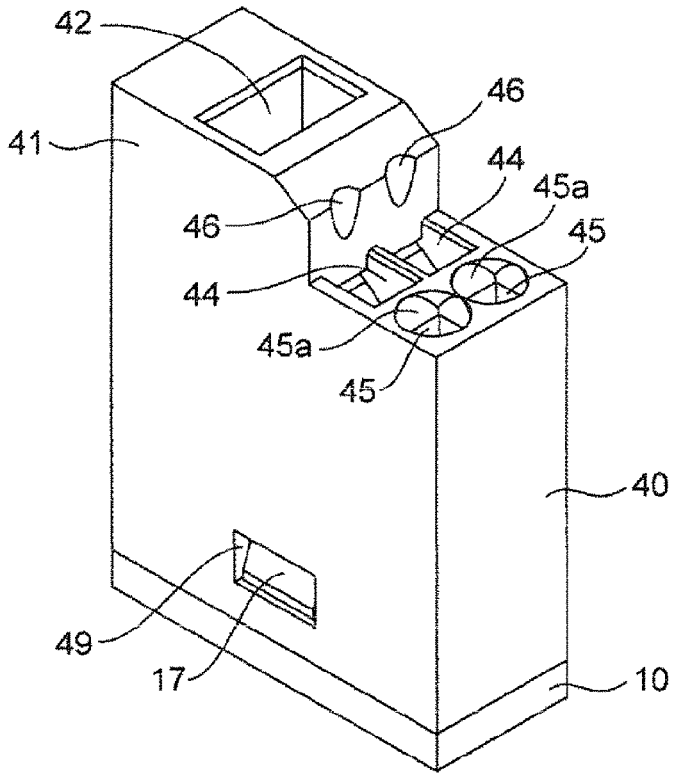
FIG. 1 is a perspective view illustrating a first embodiment of a socket according to the present invention.
Figure 2:
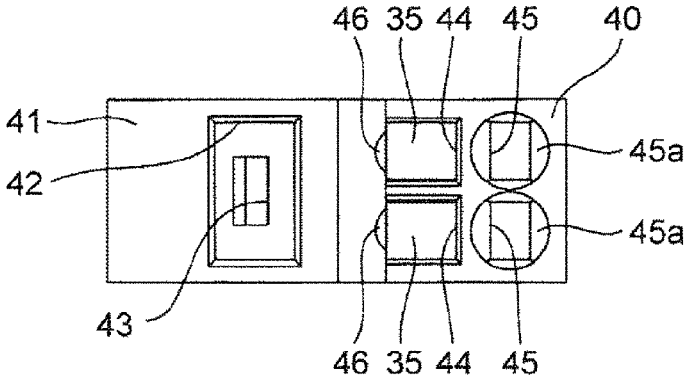
FIG. 2 is a plan view of the socket shown in FIG. 1.
Figure 3:
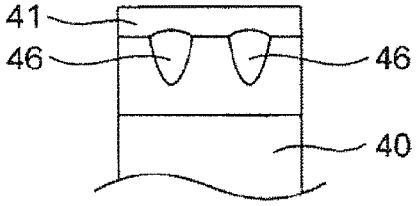
FIG. 3 is a partial front view of the socket shown in FIG. 1.

Furthermore, the case cover 40 includes engagement holes 49 (FIG. 6) which engage with the engagement claws 17 of the base 10 in opposing side surfaces.

still further, by fitting the case cover 40 to the annular step 12 of the base 10, the engagement holes 49 of the case cover 40 engage with and are integrally formed with the engagement claws 17 of the base 10 (FIG. 1). Thus, the guide partition wall 47 of the case cover 40 engages with the slit 28 of the bracket 21 and the slit 34 of the spring member 30 (FIG. 4). Further, the notch 48 of the guide partition wall 47 engages with the position restricting protrusion 15 of the base 10 to partition the pressure springs 35 and 35.

Figure 10:
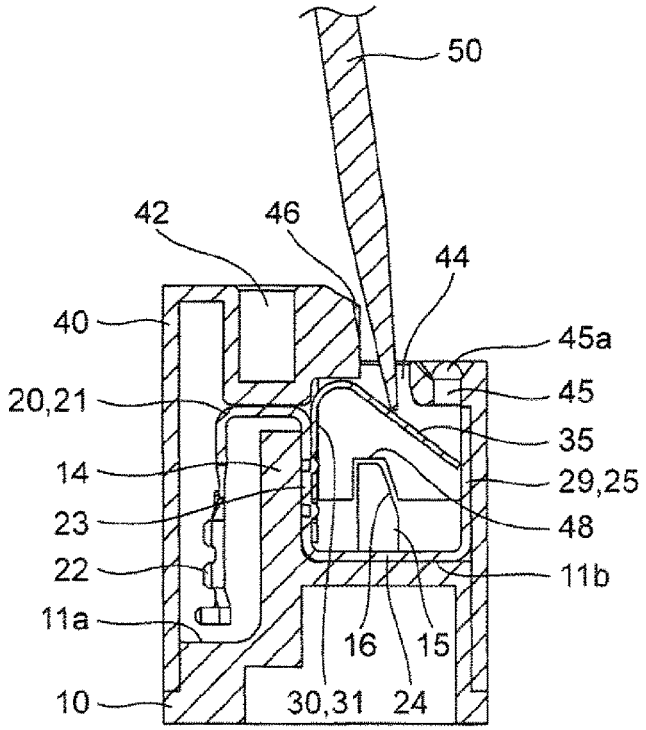
FIG. 10 is a vertical sectional view of the socket shown in FIG. 9.
Figure 11:
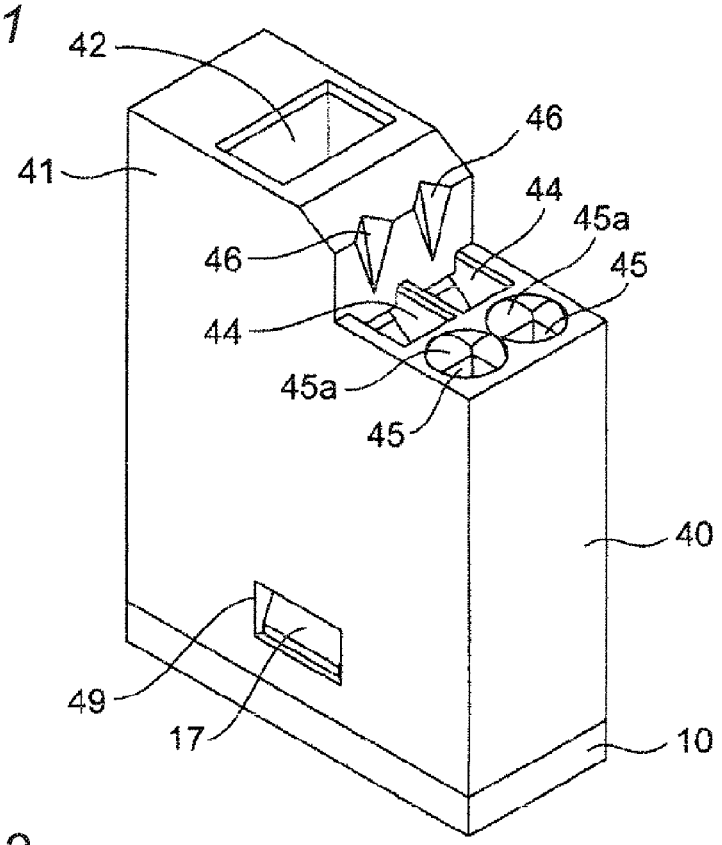
FIG. 11 is a perspective view illustrating a second embodiment of a socket according to the present invention.
Figure 12:
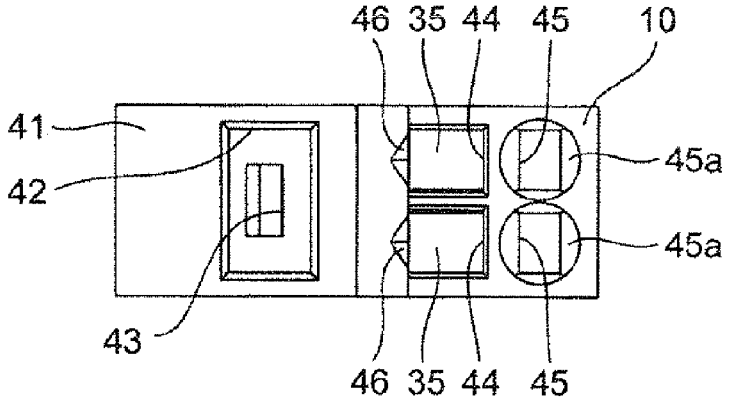
FIG. 12 is a plan view of the socket shown in FIG. 11.
Figure 13:
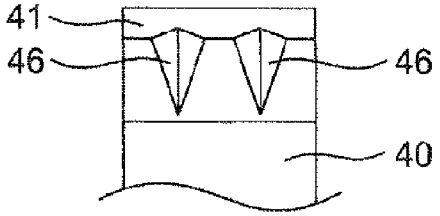
FIG. 13 is a partial front view of the socket shown in FIG. 1.
Figure 14:
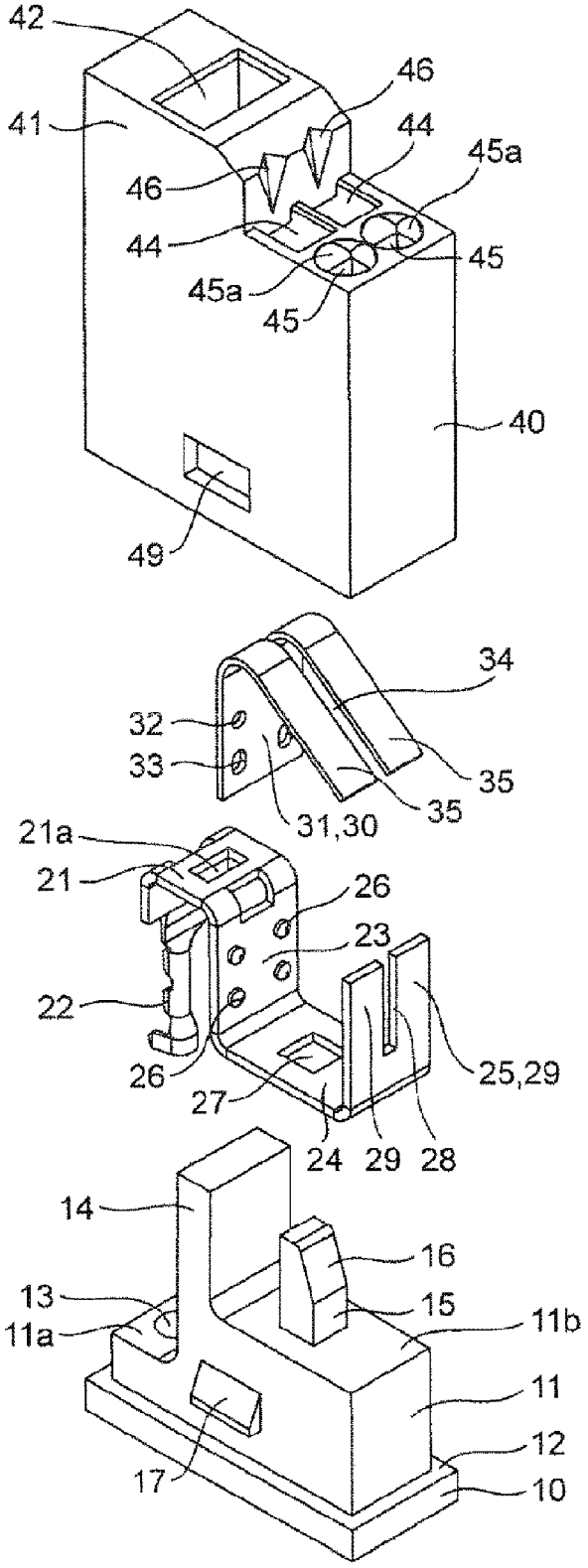
FIG. 14 is an exploded perspective view of the socket shown in FIG. 1.

When the socket is connected with a lead, as shown in FIG. 10, an operation driver 50 is inserted in the operation hole 44 to press the intermediate area of the pressure springs 35 and push down the pressure springs 35. Subsequently, the lead inserted through the insertion hole 45 is positioned between the leading end portions of the pressure springs 35 and the pressure contact receiving portions 29. Then, when the operation driver 50 is pulled, the pressure springs 35 are elastically restored, and the leading end portions of the pressure springs 35 and the pressure contact receiving portions 29 sandwich the lead.

Further, when the lead is detached, the operation driver 50 is inserted in the operation hole 44 to press the intermediate area of the pressure springs 35 and push down the pressure springs 35, so that it is possible to detach the lead.

According to the embodiment, when the operation driver 50 pushes down the pressure springs 35, the positions of the pressure springs 35 are restricted by the position restricting tapered surface 16 of the position restricting protrusion 15. Consequently, it is possible to prevent plastic deformation of the pressure springs 35.

A socket according to a second embodiment is substantially the same as that of the first embodiment as shown in FIGS. 11 to 14, and differs from the first embodiment in that a guide notch 46 provided to a step 41 of a case cover 40 is formed by a pair of flat and triangular tapered surfaces.

The guide notch 46 is formed by a pair of flat and triangular tapered surfaces. Consequently, by inserting an operation driver (not shown) along the guide notch 46, it is easy to position the operation driver. As a result, the operation driver can accurately and quickly operate the pressure springs 35.

Particularly when the operation driver is inserted along the guide notch 46, spring forces of the pressure springs 35 work on the operation driver. Hence, a retaining state of the operation driver stabilizes.

Further, placing the operation driver in direct contact with a corner of the case cover 40 without providing the guide notch 46 wears away the corner of the case cover 40. However, by providing the guide notch 46, the operation driver comes into linear contact with the guide notch 46. Consequently, there is an advantage that the case cover 40 is hardly worn away.

The other components are the same as those of the first embodiment and therefore the same components will be assigned the same reference numerals and will not be described.

EXAMPLE 1

Figure 15:
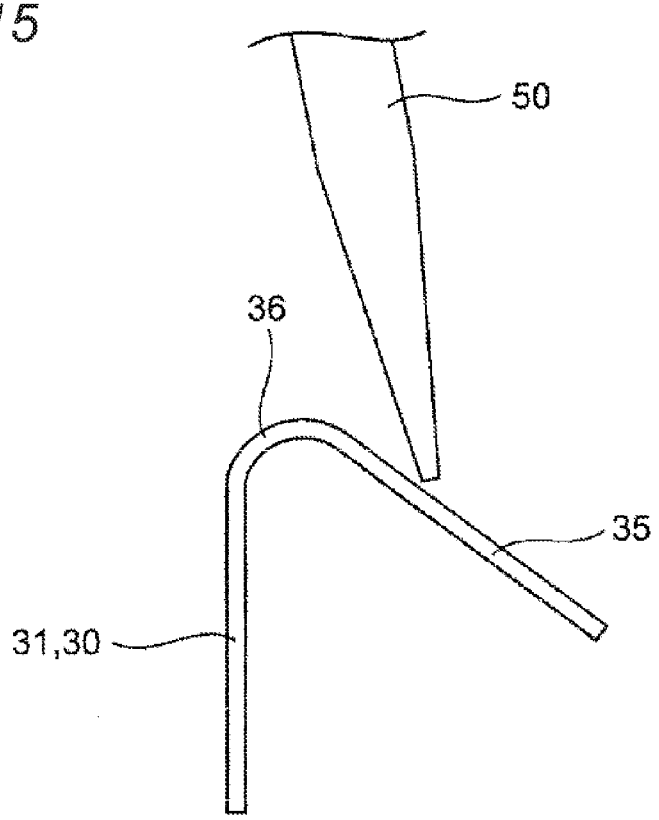
FIG. 15 is an explanatory view for explaining a method for analyzing an internal stress.
Figure 16:
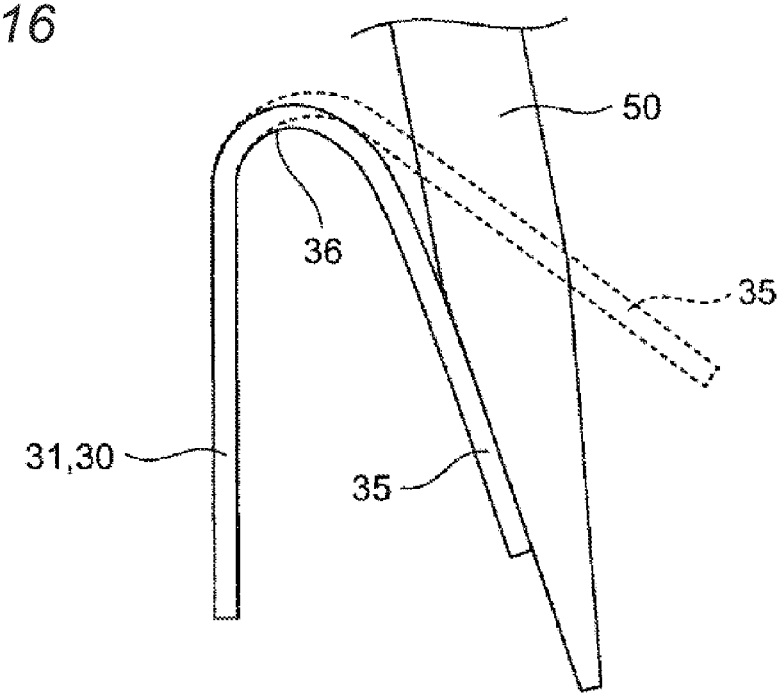
FIG. 16 is an explanatory view for explaining a method for analyzing an internal stress.
Figure 17:
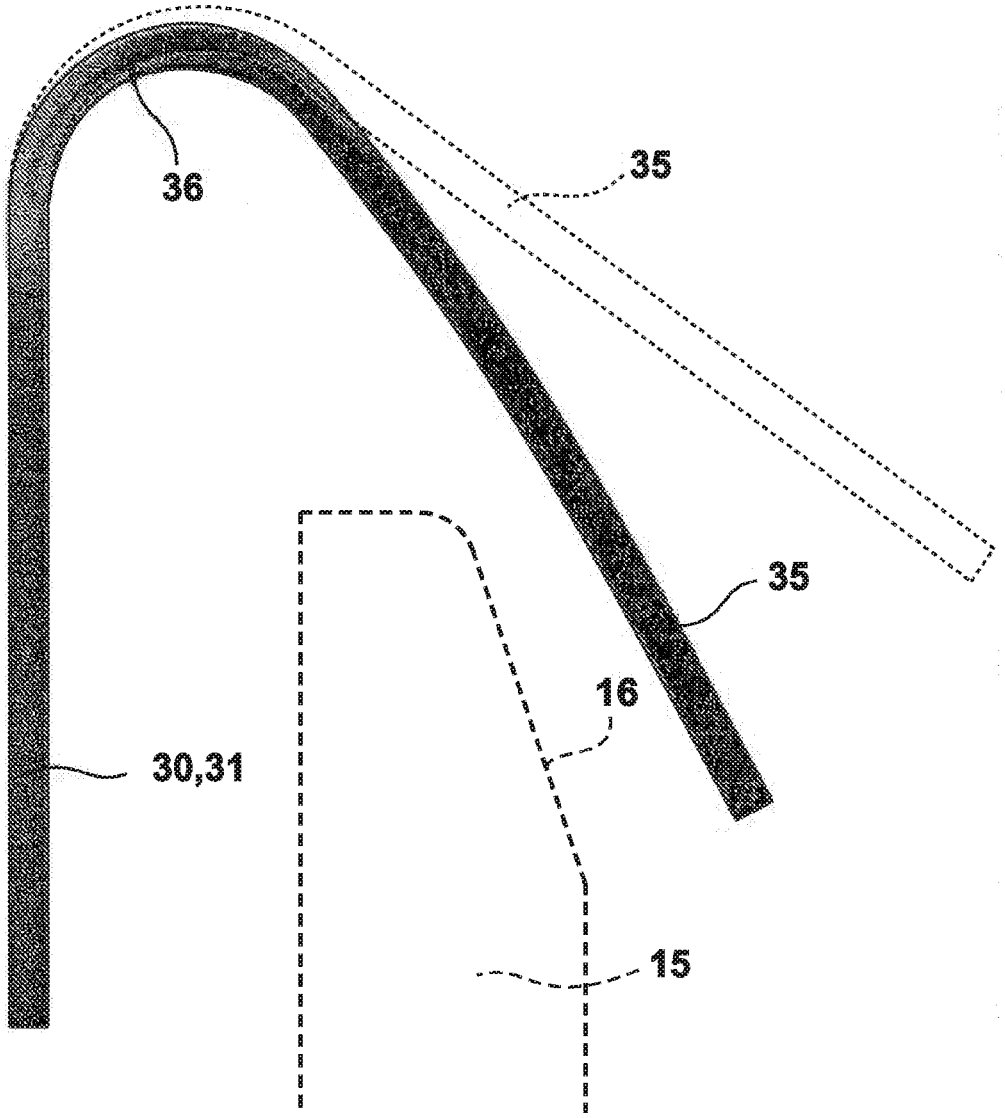
FIG. 17 is a stress distribution view illustrating an analysis result.

A stress distribution was analyzed in case where, as shown in FIGS. 15 and 16, an intermediate area of pressure springs 35 of a spring member 30 according to the above embodiments was pushed down by an operation driver 50 and was elastically deformed. FIG. 17 illustrates an analysis result.

As is clear from FIG. 17, it was found that an internal stress concentrates at a flexing portion 36 of the spring member 30, and, more particularly, a side of a caulked portion 31 of the flexing portion 36.

In addition, as shown in FIG. 17, in the above embodiments, a position restricting tapered surface 16 is provided such that the pressure springs 35 of the spring member 30 come into contact with the position restricting tapered surface 16 of a position restricting protrusion 15 in an elastic deformation area. Consequently, it is possible to prevent plastic deformation of the pressure springs 35.

The socket according to the present invention is not limited to the above-described socket, and is applicable to a socket which can connect four leads.

The invented claimed is:

1. A socket comprising:

a base; and a connection fitting including a bracket and a spring member and assembled to an upper surface of the base, the spring member of the connection fitting being pressed and elastically deformed to sandwich a lead between the bracket and the spring member, wherein the bracket of the connection fitting comprises a bottom portion that extends along the upper surface of the base, and a position restricting protrusion configured to come into contact with the pressed and deformed spring member and prevent plastic deformation is protruded on the upper surface of the base.

2. The socket according to claim 1, wherein the position restricting protrusion is integrally molded with the base.

3. The socket according to claim 1, wherein a position restricting tapered surface which the spring member comes into planar contact with is formed at an upper end of the position restricting protrusion.

4. The socket according to claim 1, wherein a fitting hole configured to fit to the position restricting protrusion protruded from the base is provided to the bottom portion of the bracket of the connection fitting.

5. The socket according to claim 1, wherein a guide partition wall is bridged between and integrally molded with a ceiling surface and an inside surface of a case cover of a box shape configured to fit to the base and to cover the connection fitting, the guide partition wall engages with a slit provided to the bracket and the spring member of the connection fitting, and an operation driver inserted along the guide partition wall through an operation hole provided on the ceiling surface of the case cover presses and elastically deforms a pressure spring of the spring member.

6. The socket according to claim 5, wherein a notch configured to engage with the position restricting protrusion provided to the base is formed at a lower end rim of the guide partition wall.

7. A socket comprising:

a base; and a connection fitting including a bracket and a spring member and assembled to an upper surface of the base, the spring member of the connection fitting being pressed and elastically deformed to sandwich a lead between the bracket and the spring member, wherein a position restricting protrusion configured to come into contact with the pressed and deformed spring member and prevent plastic deformation is protruded on the upper surface of the base, and a fitting hole configured to fit to the position restricting protrusion protruded from the base is provided to the bracket of the connection fitting.

8. The socket according to claim 7, wherein the position restricting protrusion is integrally molded with the base.

9. The socket according to claim 7, wherein a position restricting tapered surface which the spring member comes into planar contact with is formed at an upper end of the position restricting protrusion.

10. A socket comprising:

a base; and a connection fitting including a bracket and a spring member and assembled to an upper surface of the base, the spring member of the connection fitting being pressed and elastically deformed to sandwich a lead between the bracket and the spring member, wherein a position restricting protrusion configured to come into contact with the pressed and deformed spring member and prevent plastic deformation is protruded on the upper surface of the base, a guide partition wall is bridged between and integrally molded with a ceiling surface and an inside surface of a case cover of a box shape configured to fit to the base and to cover the connection fitting, the guide partition wall engages with a slit provided to the bracket and the spring member of the connection fitting, and an operation driver inserted along the guide partition wall through an operation hole provided on the ceiling surface of the case cover presses and elastically deforms a pressure spring of the spring member.

11. The socket according to claim 10, wherein the position restricting protrusion is integrally molded with the base.

12. The socket according to claim 10, wherein a position restricting tapered surface which the spring member comes into planar contact with is formed at an upper end of the position restricting protrusion.

13. The socket according to claim 10, wherein a notch configured to engage with the position restricting protrusion provided to the base is formed at a lower end rim of the guide partition wall.

* * * * *